United States Patent [19]

Marter

[11] 4,026,133

[45] May 31, 1977

[54] FLOATING BAR BALL BEARING LOCK DEVICE

[76] Inventor: V. C. Marter, 1440 Texas St., Baker, La. 70714

[22] Filed: Mar. 19, 1976

[21] Appl. No.: 668,705

[52] U.S. Cl. ..... 70/134; 70/364 A; 70/379 A

[51] Int. Cl.[2] ..... E05B 65/06

[58] Field of Search ..... 70/134, 141, 364 A, 70/379 R, 379 A, 380, DIG. 60; 292/181

[56] References Cited

UNITED STATES PATENTS

| | | | |
|---|---|---|---|
| 2,565,531 | 8/1951 | Spiegler | 70/364 A |
| 2,710,536 | 6/1955 | Stephenson | 70/364 A |
| 3,782,140 | 1/1974 | Price | 70/124 |

*Primary Examiner*—Robert L. Wolfe
*Attorney, Agent, or Firm*—Head, Johnson & Chafin

[57] ABSTRACT

A floating bar, ball bearing, dead bolt-type lock comprising rotatable plug means disposed within stationary core means and carrying a bolt rest means engagable with a reciprocal bolt member for selectively moving the bolt member between locked and unlocked positions. Floating bar means having cooperating elements disposed in both the plug means and core means retain ball bearing means in preselected positions for riding along one edge of the proper key in order to permit movement of the bolt member to an open position, and to permit movement of the bolt member to a closed position, and to substantially preclude picking of the lock.

8 Claims, 6 Drawing Figures

FLOATING BAR BALL BEARING LOCK DEVICE

BACKGROUND OF THE INVENTION

1. Field of the Invention

This invention relates to improvements in bolt type lock devices, and more particularly, but not by way of limitation, to a floating bar, ball bearing lock of the bolt type.

2. Description of the Prior Art

Key operated locks of the bolt type are old and well known, and are in widespread use today. Many attempts have been made in an effort to provide a lock of this type which is secure against picking. However, the usual lock of this type available today does not provide the quality of security required, particularly in the light of the increase in burglary in recent times.

SUMMARY OF THE INVENTION

The present invention contemplates a bolt type lock device which has been particularly designed and constructed for substantially eliminating picking of the lock. The novel lock design comprises a rotatable plug member disposed within a stationary core member and carrying a bolt rest element engagable with the bolt member for moving the bolt to a locked position, and when out of engagement with the bolt member, means is provided for moving the bolt to an unlocked position. Floating bar means is provided for the lock wherein complementary floating bar members are disposed within the plug and core means for retaining ball bearing members in the plug which "set the combination" for the lock. The complementary floating bar members form a shear line between the plug and core means when the proper key is inserted in the plug whereby the plug may be rotated in one direction for releasing the engagement of the bolt rest with the bolt member to permit the bolt member to move to the unlocked position. Conversely, the plug may be rotated in an opposite direction for engaging the bolt rest with the bolt member for moving the bolt into the locked position. The ball bearing members ride along the edge of the key as the key is inserted into the key slot of the plug means, and only when the proper key is disposed within the key slot will the floating bar members be properly positioned to provide the shear line between the plug and core means. Thus, picking of the lock, or opening of the lock with an improper key is substantially eliminated. The novel lock is simple and efficient in operation and economical and durable in construction.

DESCRIPTION OF THE PREFERRED EMBODIMENT

Figure 1:
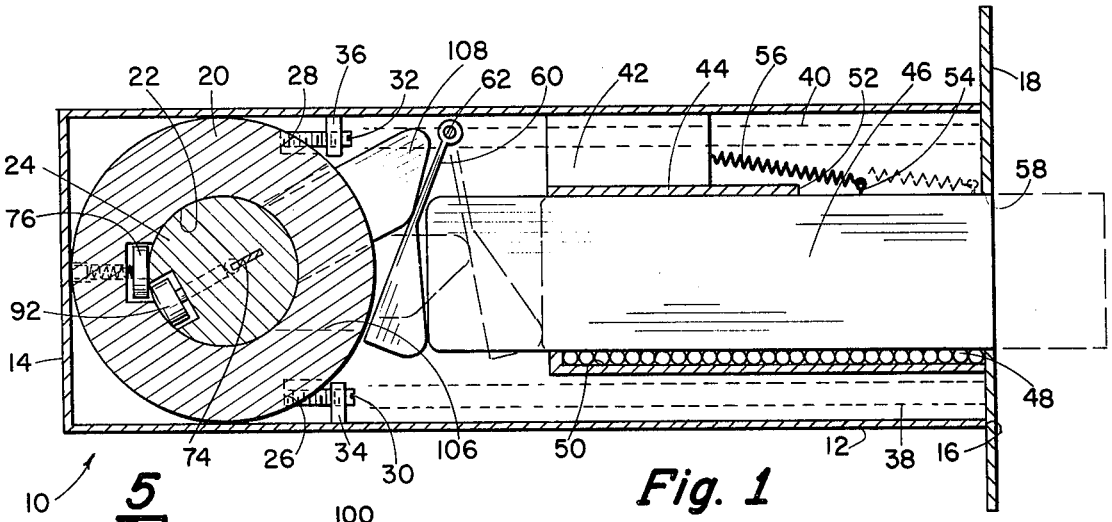
FIG. 1 is a sectional elevational view of a bolt type lock embodying the invention.

Referring to the drawings in detail, reference character 10 generally indicates a lock comprising an outer housing 12 having one end 14 thereof closed, and the opposite end 16 thereof open for receiving a suitable plate or flange 18 thereagainst. A core member 20, preferably of cylindrical configuration, but not limited thereto, is disposed within the housing 12 in the proximity of the closed end 14 thereof and extending transversely thereacross. The core 12 is provided with a central bore 22 extending longitudinally therethrough for rotatably receiving a plug member 24 therein. The core and plug assembly 20–24 preferably extends transversely throughout the entire width of the housing 12 and both ends of the assembly are preferably accessible from the exterior of the housing 12 in a manner and for a purpose as will be hereinafter set forth.

The core member 20 is retained against rotation about its own longitudinal axis in any suitable manner, and as shown herein, a pair of recessed shoulders 26 and 28 are circumferentially spaced on the outer periphery of the core 20 for receiving one end of suitable set screws 30 and 32, respectively, thereagainst. The screws 30 and 32 are threadedly secured to oppositely disposed inwardly directed flanges 34 and 36, and may be threadedly adjusted therein for engagement with the respective shoulders 26 and 28 by means of suitable screw driver means (not shown) which may be inserted within the housing 12 through the open end 16 thereof and through the passageway indicated by the broken lines 38 and 40 shown in FIG. 1.

A plurality of suitable block members 42, only one of which is shown in FIG. 1, may be secured to the inner periphery of the housing 12 in any suitable manner and spaced inwardly of the open end 16 for supporting one end of a secondary housing or sleeve 44 disposed within the housing 12. A bolt member 46, preferably constructed from a tempered steel, is slidably disposed within the secondary housing 44, and is supported by a plurality of roller bearing members or balls 48 interposed between the bolt 46 and housing 44. Of course, the bearing 48 gather in the lower portion of the housing 44 by gravity, but it may be desirable to provide a longitudinally extending recess or passageway 50 in the lower portion of the housing 44, as viewed in FIG. 1, for receiving the bearings 48 therein. It will be apparent that the bolt 46 will be freely reciprocal within the housing 44 by rolling or riding along the ball bearings 48.

A plurality of slots 52 are circumferentially spaced around the housing 44 to provide clearance for suitable eye members 54, or the like, each of which receive one end of a separate or individual retractor spring 56. The opposite end of each spring 56 is suitably anchored to one of the blocks 42, and the springs 56 cooperate for constantly urging the bolt member 46 in a left hand direction as viewed in FIG. 1, or in a direction toward the core-plug assembly 20–24. Of course, an aperture 58 is provided in the plate 18 in substantial alignment with the secondary housing 44 for receiving one end of the bolt 46 therethrough and for facilitating movement of the bolt 46 to a locked position as will be hereinafter set forth, In addition, a lever member 60 is pivotally secured within the housing 12 in any suitable manner as shown at 62 for engagement with the inwardly directed end of the bolt 46 for further facilitating movement of the bolt to a locked position.

Referring now more particularly to the core-plug assembly 20–24, the plug member 24 is provided with an outwardly directed circumferential keeper flange 64 at one end thereof for engagement with one outer face or outer end 66 of the core member 20. A keeper plate 68 is removably secured to the opposite end of the plug member 24 by suitable screw means 70, or the like, and cooperate for retaining the plug within the core 20 without interference of the rotation of the plug about its own longitudinal axis. A relatively thin key slot 72 extends longitudinally through the entire length of the plug member 24 and is accessible from both ends thereof for slidably receiving a key 74 therethrough. The proper key 74 may be inserted through either end of the key slot 72, thus permitting locking or unlocking of the lock device 10 from either the inside of the door (not shown) or the like wherein the lock 10 is installed, or from the outside thereof. Of course, it may be desirable to provide two separate keys 74 for the lock 10, with one key being utilized for the "outside" key and the other key being utilized for the "inside" key. Alternatively, it may be desirable to "set the combination" of the lock 10 in such a manner that the same key 74 may be utilized for either the inside or outside operation of the lock.

Figure 2:
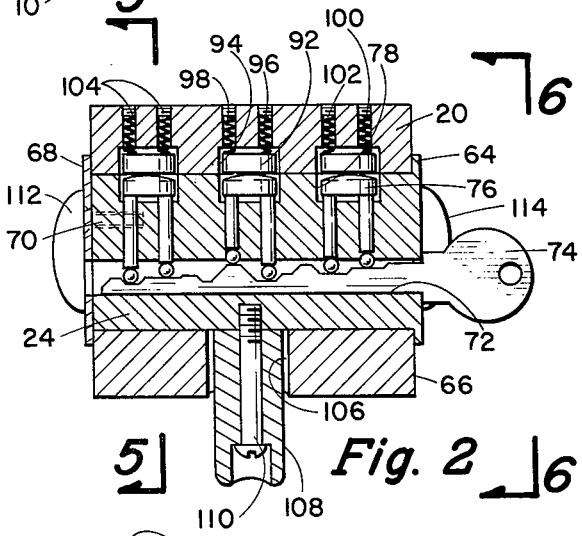
FIG. 2 is a sectional elevational view of a plug and core member of a lock embodying the invention, and illustrated in a position whereby the bolt member may be moved to an unlocked position.
Figure 5:
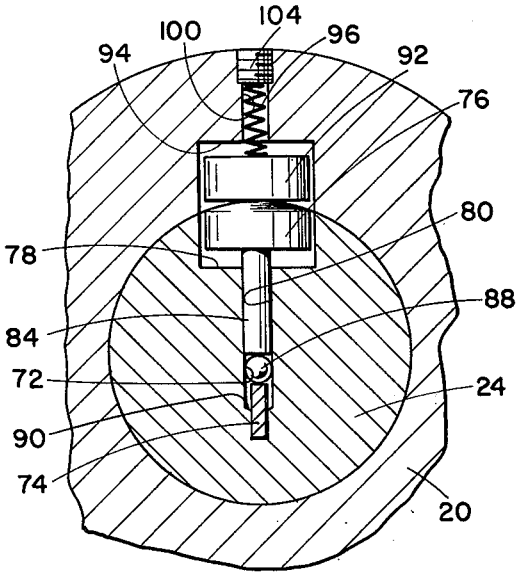
FIG. 5 is an enlarged broken elevational view taken substantially on line 5—5 of FIG. 2.

At least one first floating bar member 76 is loosely disposed in a bore 78 provided on the outer periphery of the plug 24, and as particularly shown in FIG. 2, it is preferable to provide three of the first floating bar member 76 in three respective bores 78 longitudinally spaced on the plug 24. Any number of these first floating bars may be provided, however, as desired. A pair of keeper pin bores 80 and 82 are provided for each bore 78 and extend from the bore 78 into the key slot 72 for slidably receiving individual keeper pins 84 and 86, respectively, therein. A suitable ball bearing 88 is disposed in the inwardly directed end of each bore 80 and 82, and the bores 80 and 82 are preferably inwardly tapered as the inner ends thereof, as shown at 90 in FIG. 5 for facilitating retaining of the bearings in the respective bores.

At least one second floating bar member 92 complementary to the bar 76 is loosely disposed in a bore 94 provided in the inner periphery of the bore 20 in substantial alignment with the bore 78 is one relative position between the plug 24 and core 20, as will be hereinafter set forth. Of course, it is preferable that the number of bores 94 be the same as the number of bores 78, with each corresponding pair of bores 94 and 78 being in substantial alignment in said one relative position between the plug 24 and core 20 whereby the respective floating bars 92 and 76 will normally be in engagement with each other in the locked position of the lock apparatus 10, as particularly shown in FIGS. 3 and 4, and as will be hereinafter set forth. In addition, a pair of bores 96 and 98 extend between each bore 94 and the exterior of the core 20 for receiving suitable helical spring members 100 and 102 therein, respectively. Stop members 104 are threadedly engaged in the outer ends of the bores 98 and 96 for bearing against the floating bar 92 to constantly urge the bars 92 in a direction toward the respective bar 76, or toward the plug member 24.

A circumferentially extending slot 106 is provided in the sidewall of the core 20, preferably oppositely disposed with respect to the bore or bores 94. A bolt rest arm 108 secured to the outer periphery of the plug 24 in any suitable manner, such as by a screw 110, extends radially outwardly from the plug through the slot 106, and is slidable within the slot as the plug 24 is rotated within the core 20. One direction of rotation of the plug 24 is limited by the engagement of the bolt rest arm 108 with one end of the slot 106, as shown in solid lines in FIG. 1, and the opposite direction of rotation of the plug 24 is limited by the engagement of the bolt rest arm 108 with the opposite end of the slot 106 as shown in broken lines in FIG. 1.

In the unlocked position for the lock apparatus 10, the bolt member 46 is normally retained in the withdrawn position within the housing 12 by the spring or springs 56, as shown in solid lines in FIG. 1. The inwardly directed end of the bolt 56 will normally be out of engagement with the bolt rest arm 108 since the arm 108 is normally in the upper position shown in solid lines in FIG. 1 when the lock 10 is in the unlocked position. The pivotal lever 60 is interposed between the arm 108 and the bolt 46, and depending upon the overall length of the bolt 46, either hangs loosely within the bore 12 in the unlocked position of the device 10, or is moved in a clockwise direction about the pivot 62 by the inwardly directed end of the bolt 46, as shown in solid lines in FIG. 1.

Figure 4:
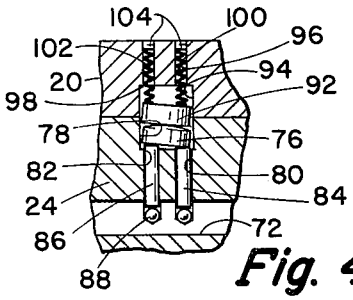
FIG. 4 is a view similar to FIG. 3, and illustrated with no key in the key slot.
Figure 6:
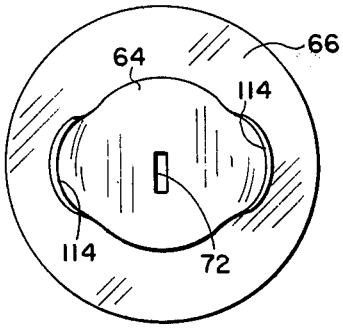
FIG. 6 is an end elevational view of a lock embodying the invention.

In this unlocked position of the device 10, the relative rotation position of the plug 24 with respect to the core 20 is such that the first floating bar or bars 76 are disposed in the bottom portion of their respective bores 78, and normally out of engagement with the inner periphery of the core 20. Simultaneously, the second floating bar or bars 92 are in engagement with the outer periphery of the plug 24, and ride easily therealong to preclude interference with any rotation of the plug 24 within the core 20. In order to lock the device 10, the plug 24 may be rotated within the core 20 about its own longitudinal axis by manually grasping one of the ears 112 and 114 provided at the opposite ends of the plug assembly. When the plug 24 has been rotated through a sufficient distance, preferably until the bolt rest arm 108 has been brought into engagement with the respective end of the slot 106, the first floating bar or bars 76 will be moved into substantial alignment with the second floating bar or bars 92, whereupon the springs 100 and 102 will move the floating bars 92 in a direction toward the bars 76, and ultimately move both bars 76 and 92 to the limit of the movement thereof as determined by the depth of the bore 78, and as shown in FIG. 4. It will be readily apparent that the cooperating floating bars 76 and 92 lock or break the "shear line" between the plug 24 and core 20, and preclude any rotation of the plug 24 with respect to the core 20.

Simultaneously with the rotation of the plug 24 within the core 20, the bolt rest arm 108 moves from the position shown in solid lines in FIG. 1 toward the position shown in broken lines therein. As the bolt rest arm 108 moves with the plug 24, the arm engages the inwardly directed end of the bolt 46 and slides the bolt 46 in a right hand direction as viewed in FIG. 1, and to the position shown in broken lines. Of course, the outer end of the bolt 46 may thus be inserted into a suitable recess (not shown) in a door opening (not shown), or the like, wherein the lock 10 is installed for locking the door (not shown) in the opening, as is well known.

Figure 3:
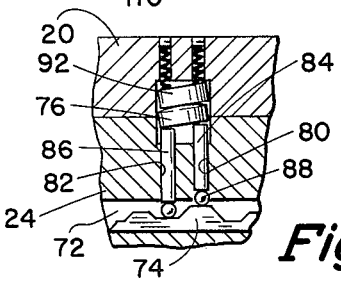
FIG. 3 is a broken sectional view of a floating bar and ball bearing means such as used in the invention and illustrated with a key in position in the key slot.

In order to unlock the device 10, the proper key 74 may be inserted into the key slot 72 from either end thereof whereby the notched edge of the key will pick up the ball bearings 88 sequentially, as particularly shown in FIG. 3 and only when all of the balls 88 have been picked up in accordance with the present combination for the lock 10 will the first floating bars be positioned with the outer end thereof in substantially alignment with the outer periphery of the plug 24, and the second floating bars be positioned in substantial alignment with the inner periphery of the core 20 for re-establishing the "shear line" is established, the plug 24 may be turned within the core 20 by either the key 74, or by the ears 112 and 114 for unlocking the device 10. When the plug 24 is rotated for moving the bolt rest arm 108 away from the bolt 46, the springs 56 will withdraw the bolt into the housing 12.

In order to provide the desired combination for the lock 10, the length of each of the keeper pins 84 and 86 may be selected for cooperation with a particular configuration of the notched edge of the key 74. The plug 24 may be rotated within the core 20 only when each and every ball bearing 88 is held securely in its preselected position for cooperating with the respective keeper pin for maintaining the floating bars 76 and 92 in the proper relative position with respect to the "shear line" between the plug and core. It will thus be apparent that picking of the lock 10 is substantially impossible. The combination for the lock may be so selected that a single key may be utilized from either end of the key slot 72, or in such a manner that separate keys must be used from each end of the key slot 72, as desired.

From the foregoing, it will be apparent that the present invention provides a novel bolt type lock having complementary floating bar means cooperating with ball bearing means for substantially precluding picking of the lock device. The ball bearing means is so arranged as to respond only to the preselected key configuration for establishing a "shear line" within the lock for permitting rotating of the plug within the core and withdrawing the bolt into the lock housing.

Whereas the present invention has been described in particular relation to the drawings attached hereto, it should be understood that other and further modifications, apart from those shown or suggested herein may be made within the spirit and scope of this invention.

What is claimed is:

1. A dead bolt type lock device comprising housing means, sleeve means substantially concentrically arranged within said housing means and having the opposite ends thereof open, reciprocal bolt means disposed within said sleeve means, yieldable means connected between the housing means and bolt means for constantly urging said bolt in one direction, bolt engaging means disposed within said housing means and operable for engaging said bolt and selectively moving said bolt against the force of said first mentioned means, key slot means for receiving a key therein, and floating bar and ball bearing means in communication with said key slot means and cooperating with said bolt engaging means for actuation thereof to provide alternate extended and contracted positions for the bolt with respect to the housing means to provide locked and unlocked positions for the locking device.

2. A lock device as set forth in claim 1 wherein said bolt engaging means comprises stationary core means, rotatable plug means disposed within said core means, and bolt rest arm means secured to said plug means for movement simultaneously therewith and extending radially outwardly from said core means for engagement with said bolt means.

3. A lock device as set forth in claim 2 wherein said core means is provided with a circumferentially extending slot in the sidewall thereof for receiving the bolt rest arm means therethrough, and wherein the opposite ends of said slot are engagable by said bolt rest arm means for limiting the rotation of the plug means in opposite directions.

4. A lock device as set forth in claim 2 wherein said floating bar and ball bearing means comprises at least one floating bar member carried by said rotatable plug means, at least one complementary floating bar member carried by said core means and cooperating with said first mentioned floating bar member in one relative position between the plug means and core means to provide a shear line therebetween for free rotation of the plug means and in another relative position between the plug means and core means to preclude rotation of the plug means with respect to said core means.

5. A lock device as set forth in claim 4 wherein said ball bearing means comprises radially extending bore means provided in said plug means and in communication with said key slot means, ball bearing means loosely disposed in said bore means, keeper pin means slidably disposed in said bore means and engagable with said ball bearing means and said first mentioned bloating bar member, said ball bearing means being engagable by said key for moving said keeper pin means in accordance with the combination of the lock for unlocking said lock device.

6. In a dead bolt-type lock device, a core-plug assembly having a longitudinal axis substantially perpendicular to the axis of the bolt and comprising a stationary core member having a rotatable plug member disposed therein, key slot means extending longitudinally through said plug member, bolt rest arms means carried by the plug member and extending radially outwardly from the core member for selective engagement with the bolt in the proximity of one end thereof, floating bar means and ball bearing means in communication with said key slot means and cooperating between said core member and plug member whereby the bolt rest arm means moves the bolt member to an extended locking position in one relative rotational position between the core member and plug member and to a contracted unlocking position in another relative rotational position between said core member and plug member, and said ball bearing means cooperates with said floating bar means for permitting independent rotation of the plug member under preselected relative positional conditions for the ball bearing means.

7. In a dead bolt-type lock device, a core-plug assembly as set forth in claim 6 wherein the floating bar means comprises first floating bar means loosely disposed within sid plug member, second floating bar means loosely disposed in said core member, spring means provided in said core member and accessible from the exterior of said core member, said spring means being in direct engagement with said second floating bar means in a direction toward said plug means, said first floating bar means being responsive to the relative position of said ball bearing means for selectively engaging said second floating bar means to establish a shear line between the plug member and core member in one relative rotational position therebetween whereby said plug member may be freely rotated within said core member.

8. In a bolt-type lock device, a core-plug assembly as set forth in claim 7 wherein said ball bearing means comprises radially extending bore means communicating between said first floating bar means and said key slot means, ball means disposed in said radial bore means, keeper pin means slidably disposed in said radial bore means and in engagement with said ball means and first floating bar means and responsive to the relative position of said ball means for adjusting the position of said first floating bar means to provide said relative positions of said first and second floating bar means.

* * * * *